US007395857B2

(12) United States Patent
Hillis

(10) Patent No.: US 7,395,857 B2
(45) Date of Patent: Jul. 8, 2008

(54) METHODS AND APPARATUS FOR EXPANDING TUBING WITH AN EXPANSION TOOL AND A CONE

(75) Inventor: David John Hillis, Balmedie (GB)

(73) Assignee: Weatherford/Lamb, Inc., Houston, TX (US)

( * ) Notice: Subject to any disclaimer, the term of this patent is extended or adjusted under 35 U.S.C. 154(b) by 358 days.

(21) Appl. No.: 10/887,237

(22) Filed: Jul. 7, 2004

(65) Prior Publication Data

US 2005/0023001 A1 Feb. 3, 2005

(30) Foreign Application Priority Data

Jul. 9, 2003 (GB) ..... 0315997.7

(51) Int. Cl.
*E21B 43/10* (2006.01)

(52) U.S. Cl. ..... 166/207; 166/206; 166/212

(58) Field of Classification Search ..... 166/380, 166/207, 384
See application file for complete search history.

(56) References Cited

U.S. PATENT DOCUMENTS

| | | | | |
|---|---|---|---|---|
| 761,518 | A | 5/1904 | Lykken | |
| 1,233,888 | A | 7/1917 | Leonard | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,880,218 | A | 10/1932 | Simmons | |
| 1,930,825 | A | 10/1933 | Raymond | |
| 2,383,214 | A | 8/1945 | Prout | |
| 2,499,630 | A | 3/1950 | Clark | |
| 2,627,891 | A | 2/1953 | Clark | |
| 2,663,073 | A | 12/1953 | Bieber et al. | |
| 2,898,971 | A | 9/1959 | Hempel | |
| 3,087,546 | A | 4/1963 | Wooley | |
| 3,179,168 | A * | 4/1965 | Vincent | 166/277 |
| 3,188,850 | A | 6/1965 | Linthicum et al. | |
| 3,195,646 | A | 7/1965 | Brown | |
| 3,353,599 | A | 11/1967 | Swift | |
| 3,412,565 | A | 11/1968 | Lindsey et al. | |

(Continued)

FOREIGN PATENT DOCUMENTS

EP 0 961 007 A2 12/1999

(Continued)

OTHER PUBLICATIONS

GB Search Report dated, Oct. 22, 2003 from GB Application No. 0315997.7.

(Continued)

*Primary Examiner*—Jennifer H. Gay
*Assistant Examiner*—Brad Harcourt
(74) *Attorney, Agent, or Firm*—Patterson & Sheridan, L.L.P.

(57) ABSTRACT

A method of expanding tubing such as a section of casing includes locating the casing in a bore and expanding a portion of the casing to engage the bore wall using an expansion tool having at least one radially movable expansion member. The expansion member may be in the form of a roller of a rotary expander. The method additionally includes subsequently expanding a further portion of the casing by advancing a cone expander through the casing.

30 Claims, 1 Drawing Sheet

U.S. PATENT DOCUMENTS

| | | | |
|---|---|---|---|
| 3,467,180 | A | 9/1969 | Pensotti |
| 3,529,667 | A | 9/1970 | Malone |
| 3,669,190 | A | 6/1972 | Sizer et al. |
| 3,818,734 | A | 6/1974 | Bateman |
| 3,911,707 | A | 10/1975 | Minakov et al. |
| 4,069,573 | A | 1/1978 | Rogers, Jr. et al. |
| 4,127,168 | A | 11/1978 | Hanson et al. |
| 4,159,564 | A | 7/1979 | Cooper, Jr. |
| 4,288,082 | A | 9/1981 | Setterberg, Jr. |
| 4,311,194 | A | 1/1982 | White |
| 4,324,407 | A | 4/1982 | Upham et al. |
| 4,393,931 | A | 7/1983 | Muse et al. |
| 4,429,620 | A | 2/1984 | Burkhardt et al. |
| 4,531,581 | A | 7/1985 | Pringle et al. |
| 4,588,030 | A | 5/1986 | Blizzard |
| 4,697,640 | A | 10/1987 | Szarka |
| 4,848,462 | A | 7/1989 | Allwin |
| 4,848,469 | A | 7/1989 | Baugh et al. |
| 4,862,966 | A | 9/1989 | Lindsey et al. |
| 5,014,779 | A | 5/1991 | Meling et al. |
| 5,027,894 | A | 7/1991 | Coone et al. |
| 5,048,612 | A | 9/1991 | Cochran |
| 5,086,845 | A | 2/1992 | Baugh |
| 5,181,570 | A | 1/1993 | Allwin et al. |
| 5,220,959 | A | 6/1993 | Vance, Sr. |
| 5,271,472 | A | 12/1993 | Leturno |
| 5,297,633 | A | 3/1994 | Snider et al. |
| 5,409,059 | A | 4/1995 | McHardy |
| 5,435,400 | A | 7/1995 | Smith |
| 5,467,826 | A | 11/1995 | Miller |
| 5,472,057 | A | 12/1995 | Winfree |
| 5,494,106 | A | 2/1996 | Gueguen et al. |
| 5,560,426 | A | 10/1996 | Trahan et al. |
| 5,685,369 | A | 11/1997 | Ellis et al. |
| 5,695,008 | A | 12/1997 | Bertet et al. |
| 5,785,120 | A | 7/1998 | Smalley et al. |
| 5,833,001 | A | 11/1998 | Song et al. |
| 5,901,787 | A | 5/1999 | Boyle |
| 5,918,677 | A | 7/1999 | Head |
| 6,021,850 | A | 2/2000 | Wood et al. |
| 6,056,536 | A | 5/2000 | Schad et al. |
| 6,065,536 | A | 5/2000 | Gudmestad et al. |
| 6,073,692 | A | 6/2000 | Wood et al. |
| 6,085,838 | A | 7/2000 | Vercaemer et al. |
| 6,098,717 | A | 8/2000 | Bailey et al. |
| 6,253,850 | B1 | 7/2001 | Nazzai et al. |
| 6,325,148 | B1 | 12/2001 | Trahan et al. |
| 6,425,444 | B1 | 7/2002 | Metcalfe et al. |
| 6,446,323 | B1 | 9/2002 | Metcalfe et al. |
| 6,446,724 | B2 | 9/2002 | Baugh et al. |
| 6,454,013 | B1 | 9/2002 | Metcalfe |
| 6,457,532 | B1 | 10/2002 | Simpson |
| 6,457,533 | B1 | 10/2002 | Metcalfe |
| 6,527,049 | B2 | 3/2003 | Metcalfe et al. |
| 6,543,552 | B1 | 4/2003 | Metcalfe et al. |
| 6,543,816 | B1 | 4/2003 | Noel |
| 6,578,630 | B2 | 6/2003 | Simpson et al. |
| 6,598,677 | B1 | 7/2003 | Baugh et al. |
| 6,648,075 | B2 | 11/2003 | Badrak et al. |
| 6,662,876 | B2 | 12/2003 | Lauritzen |
| 6,702,029 | B2 | 3/2004 | Metcalfe et al. |
| 6,708,767 | B2 * | 3/2004 | Harrall et al. ..... 166/382 |
| 6,742,606 | B2 | 6/2004 | Metcalfe et al. |
| 6,860,329 | B1 | 3/2005 | Oosterling |
| 2001/0020532 | A1 | 9/2001 | Baugh et al. |
| 2002/0079101 | A1 * | 6/2002 | Baugh et al. ..... 166/285 |
| 2002/0079106 | A1 | 6/2002 | Simpson |
| 2002/0108756 | A1 * | 8/2002 | Harrall et al. ..... 166/382 |
| 2002/0163192 | A1 | 11/2002 | Coulon et al. |
| 2003/0047320 | A1 | 3/2003 | Badrak et al. |
| 2003/0127774 | A1 | 7/2003 | Stephenson et al. |
| 2003/0183395 | A1 | 10/2003 | Jones |
| 2004/0123983 | A1 | 7/2004 | Cook et al. |
| 2004/0244992 | A1 | 12/2004 | Carter et al. |

FOREIGN PATENT DOCUMENTS

| | | |
|---|---|---|
| GB | 2 320 734 | 7/1998 |
| GB | 2 326 896 | 1/1999 |
| GB | 2 344 696 | 3/2000 |
| GB | 2 344 606 | 6/2000 |
| GB | 2350137 A | 11/2000 |
| GB | 2382605 | 6/2003 |
| WO | WO 93/24728 | 12/1993 |
| WO | WO 93/25799 | 12/1993 |
| WO | WO 9706346 | 2/1997 |
| WO | WO 99/18328 | 4/1999 |
| WO | WO 99/23354 | 5/1999 |
| WO | WO 99/35368 | 7/1999 |
| WO | WO 00/37766 | 6/2000 |
| WO | WO 02/25056 | 3/2002 |
| WO | WO 2003/006788 A1 | 1/2003 |
| WO | WO 2004/027205 | 4/2004 |
| WO | WO 2004/083594 | 9/2004 |
| WO | WO 2004/085790 | 10/2004 |
| WO | WO 2004/089608 | 10/2004 |
| WO | WO 2004/092527 | 10/2004 |
| WO | WO 2004/092528 | 10/2004 |
| WO | WO 2004/094766 | 11/2004 |
| WO | WO 02/081863 | 10/2005 |

OTHER PUBLICATIONS

U.K. Search Report, Application No. GB0415000.9, dated Sep. 6, 2004.

PCT Search Report International Application No. PCT/GB 02/05830, dated Aug. 12, 2003.

* cited by examiner

METHODS AND APPARATUS FOR EXPANDING TUBING WITH AN EXPANSION TOOL AND A CONE

CROSS-REFERENCE TO RELATED APPLICATIONS

This application claims benefit of Great Britain patent application serial number GB 0315997.7, filed Jul. 9, 2003, which is herein incorporated by reference.

BACKGROUND OF THE INVENTION

1. Field of the Invention

This invention relates to expanding tubing, and in particular to expansion of tubing downhole. Embodiments of the invention relate to anchoring and expanding tubing downhole.

2. Description of the Related Art

The present applicant and others have made various proposals relating to anchoring tubing in a bore by diametrically expanding the tubing into engagement with surrounding tubing. For example, in applicant's GB-A-2 345 308 there is disclosed a method of creating a tubing hanger by expanding tubing into engagement with existing tubing using a radially expandable tool, and subsequently advancing the tool through anchored tubing to expand the tubing.

It is among the objectives of embodiments of the invention to provide alternative methods for anchoring and expanding tubing.

SUMMARY OF THE INVENTION

According to the present invention there is provided a method of anchoring and expanding tubing, the method comprising:

locating tubing in a bore;

expanding a portion of the tubing to engage the bore wall using an expansion tool having at least one radially movable expansion member; and then expanding a further portion of the tubing by advancing a cone expander through the tubing.

According to another aspect of the invention there is provided apparatus for expanding tubing, the apparatus comprising:

an expansion tool having at least one radially movable expansion member; and a cone expander.

The invention has particular utility in downhole applications, but may be utilised in other situations, for example in subsea risers or in subsea or surface pipelines. For downhole applications the tubing may take any appropriate form or serve any appropriate function, but will typically be bore-lining casing.

Initial expansion of a portion of the tubing using the expansion tool may serve to anchor the tubing relative to the bore wall, which will typically be defined by existing tubing, which existing tubing may be cemented and thus of fixed diameter and not capable of expansion. The use of an expansion tool having at least one radially movable expansion member avoids many of the risks inherent in attempting to expand tubing in such situations, as the expansion tool may accommodate anomalies in tubing shape, condition and internal diameter (ID) dimension. The cone expander may then be utilised to expand a further portion of the tubing, which may comprise all or a substantial portion of the remainder of the tubing below the anchor. The cone expander may be advanced through the tubing relatively quickly, and may be better suited to expanding extended lengths of tubing than other forms of expansion tools.

The expansion tool for expanding said portion of the tubing may take any appropriate form, including a cone which is one or both of compliant and expandable, such as an expansion tool having a substantially cone-shaped expansion member adapted to be advanced axially through the tubing and capable of radial deflection to accommodate, for example, sections of tubing which cannot be expanded to a desired diameter. The cone may be adapted for sliding contact with the tubing or may feature a surface at least partially defined by rolling elements. Most preferably however, the expansion tool is a rotary expander, and may feature a plurality of circumferentially spaced expansion members. Examples of rotary expanders are set out in applicant's WO00/37766, the disclosure of which is incorporated herein by reference.

The expansion tool may be actuated to extend the expansion member by any appropriate means, but is most preferably fluid-pressure actuated.

The tubing may be cemented prior to or following expansion.

Said portion of the tubing may be expanded to engage the bore wall while retaining a fluid passage between the tubing and the wall. The passage may be useful to allow displacement of fluid in subsequent cementing operations. Alternatively, ports or other means may be provided to permit fluid bypass.

BRIEF DESCRIPTION OF THE DRAWINGS

These and other aspects of the present invention will now be described, by way of example, with reference to the accompanying drawings, in which.

DETAILED DESCRIPTION

Figures 1, 2, 3, 4, 5:
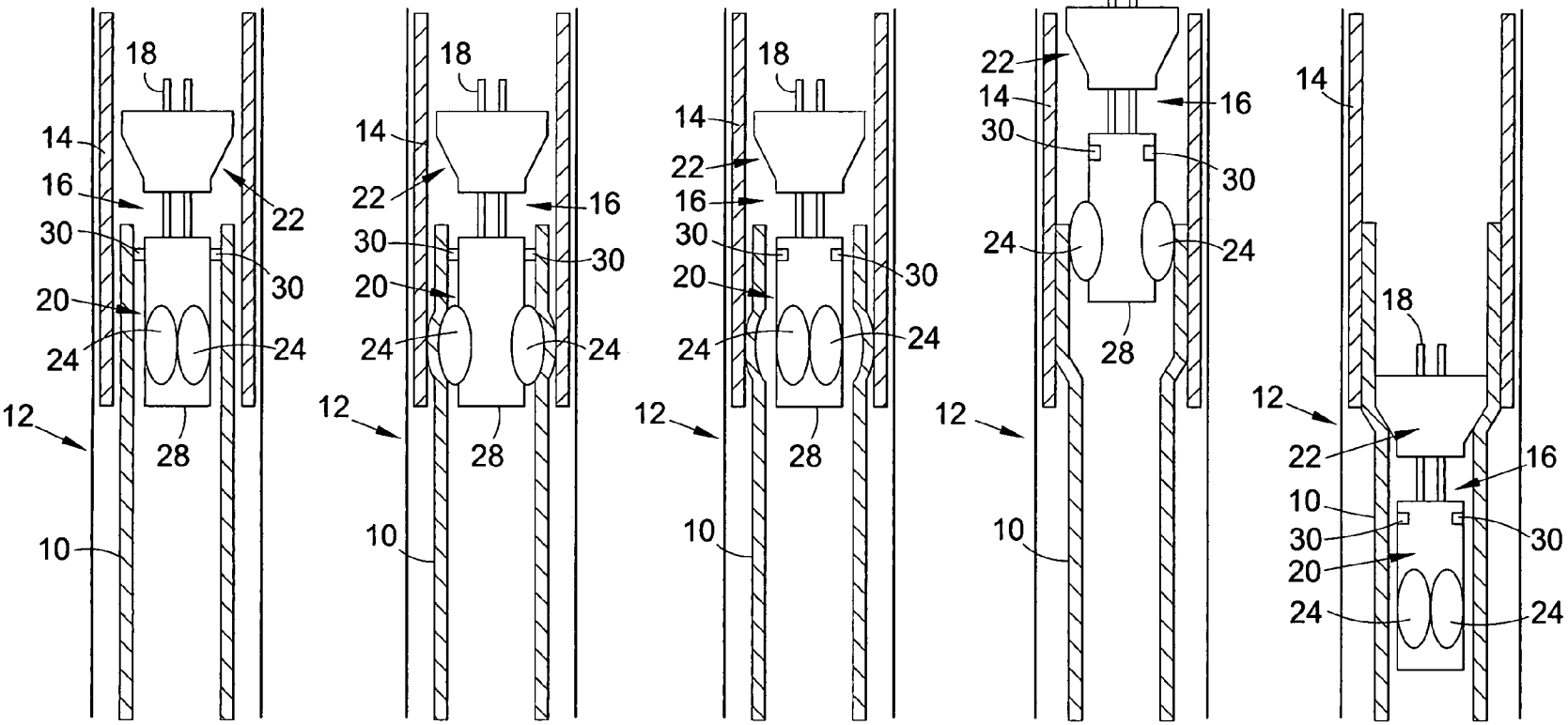
FIGS. 1 to 5 are schematic illustrations of tubing being anchored in a bore and then expanded, in accordance with a preferred embodiment of the present invention.

The figures illustrate steps in the process of anchoring and then expanding a section of casing 10 in a drilled subsurface bore 12. In particular, the casing 10 is located with an upper end overlapping the lower end of existing casing 14, and the remainder of the casing 10 extending into an unlined section of bore below the existing casing 14.

The casing 10 is run into the bore 12 together with an anchoring and expansion apparatus 16, and mounted on the lower end of an appropriate pipe string 18. The apparatus comprises two expansion tools 20, 22, a compliant rotary expander 20 and a cone expander 22. Initially, the rotary expander 20 is located within the upper end of the casing 10, and is run into the bore in this position.

The expander 20 features a number of piston-mounted rollers 24 on the hollow tool body 28. The rollers 24 are initially retracted, but application of elevated fluid pressure to the interior of the body 28, via the pipe string 18, urges the rollers 24 radially outwardly, as will be described. The expander 20 is initially fixed axially relative to the casing 10 by retractable dogs 30.

The cone expander 22 is a fixed diameter cone of suitable hard-wearing material, and may include metallic or ceramic elements. The expander is mounted on the pipe string 18 above the rotary expander 20, and is initially located above the upper end of the casing 10.

The casing string 10 will be made up on surface and then run into the bore 12 with the anchoring and expansion apparatus 16 and located relative to the existing casing 14 as illustrated in FIG. 1. The rotary expander 20 is then actuated to extend the rollers 24 into contact with the surrounding casing 10 and to deform the casing 10 such that the outer surface of the casing 10 contacts the inner surface of the existing casing 14, as illustrated in FIG. 2. It may be sufficient simply to extend the rollers 24 and deform the casing to achieve an initial hanging support for the casing 10 from the casing 14, as described in applicant's GB-A-2 345 308, the disclosure of which is incorporated herein by reference. However, in other cases it may be desirable or necessary to rotate the expander 20 within the casing 10 to create a larger area contact between the casings 10, 14. In this case the initial deformation of the casing 10 need only be sufficient to prevent relative rotation between the sections of casing 10, 14, and of course this would require the provision of a swivel between the expander 20 and the dogs 30.

In any event, the dogs 30 may then be released (FIG. 3), to allow the apparatus 16 to be moved axially upwards relative to the casing 10, and the expander 20 utilised to expand the portion of the casing 10 overlapping with the existing casing 16, as illustrated in FIG. 4. The use of a compliant expander 20 at this stage will accommodate and compensate for any anomalies in the casing shape, condition or ID dimension. Once this section of the casing has been expanded the rollers 24 may retract.

The remainder of the casing 10, extending into the unlined section of bore below the casing 14, may then be expanded by driving the cone expander 22 axially down through the casing 10, as illustrated in FIG. 5. As a degree of clearance will remain between the expanded casing 10 and the surrounding bore wall, anomalies in the casing 10, for example an area of increased wall thickness, may be accommodated without difficulty.

Those of skill in the art will appreciate that the invention provides a method of anchoring and expanding tubing which takes advantage of the attributes of the different forms of expansion tools.

Those skilled in the art will also recognise that this embodiment is merely exemplary of the present invention and that various modifications and improvements may be made thereto, without departing from the present invention. For example, rather than casing 10 as described above, the invention may be utilised to anchor and locate liner in a bore.

The invention claimed is:

1. A method of anchoring and expanding tubing, the method comprising:

locating tubing in a bore;

expanding a portion of the tubing to engage the bore wall using an expansion tool having at least one radially movable expansion member; and then expanding a further portion of the tubing by advancing a fixed diameter cone expander through the tubing, wherein the cone expander is located in the bore and outside the tubing prior to expanding the tubing.

2. The method of claim 1, wherein the tubing is expanded downhole.

3. The method of claim 2, further comprising running the expansion tool and cone expander into the bore together with the tubing.

4. The method of claim 3, comprising initially locating the expansion tool within the tubing.

5. The method of claim 1, wherein the tubing is bore-lining casing.

6. The method of claim 1, wherein the tubing is liner.

7. The method of claim 1, wherein expansion of said portion of the tubing using the expansion tool anchors the tubing relative to the bore.

8. The method of claim 1, wherein said portion of the tubing is expanded by the expansion tool within a section of existing tubing.

9. The method of claim 8, comprising locating an upper end of the tubing in overlapping relation with a lower end of a section of existing tubing.

10. A method of anchoring and expanding tubing, the method comprising:

locating tubing in a bore;

expanding a portion of the tubing to engage the bore wall using an expansion tool having at least one radially movable expansion member; and then expanding a further portion of the tubing by advancing a fixed diameter cone expander through the tubing, wherein the cone expander is located in the bore and outside the tubing prior to expanding the tubing, and wherein said further portion of the tubing is located in unlined bore.

11. The method of claim 1, wherein the expansion tool for expanding said portion of the tubing comprises a compliant cone.

12. The method of claim 1, wherein the expansion tool for expanding said portion of the tubing comprises an expandable cone.

13. The method of claim 1, wherein the expansion tool for expanding said portion of the tubing comprises a rotary expander.

14. The method of claim 1, wherein the expansion tool for expanding said portion of the tubing comprises a rotary expander having a plurality of circumferentially spaced expansion members.

15. The method of claim 1, wherein the expansion tool for expanding said portion of the tubing comprises a fluid-pressure actuated expansion member.

16. The method of claim 1, further comprising cementing the tubing in the bore.

17. The method of claim 16, comprising cementing the tubing prior to expansion.

18. The method of claim 16, comprising cementing the tubing following expansion.

19. The method of claim 1, comprising expanding said portion of the tubing to engage the bore wall while retaining a fluid passage between the tubing and the wall.

20. Apparatus for expanding tubing, the apparatus comprising:

downhole tubing;

an expansion tool having at least one radially movable expansion member, wherein the expansion tool is releasably coupled to the tubing; and a cone expander located outside the tubing and coupled to the expansion tool that is releasably coupled to the tubing with said expansion tool located within the tubing.

21. The apparatus of claim 20, adapted for operation downhole.

22. The apparatus of claim 20, wherein the expansion tool comprises a compliant cone.

23. The apparatus of claim 20, wherein the expansion tool comprises an expandable cone.

24. The apparatus of claim 20, wherein the expansion tool comprises a rotary expander.

25. The apparatus of claim 20, wherein the expansion tool comprises a rotary expander having a plurality of circumferentially spaced expansion members.

26. The apparatus of claim 20, wherein the expansion tool comprises a fluid-pressure actuated expansion member.

27. The apparatus of claim 20, wherein the expansion tool comprises a plurality of circumferentially spaced expansion members.

28. The apparatus of claim 20, wherein the at least one expansion member comprises a roller.

29. The apparatus of claim 20, wherein the cone expander has a fixed diameter.

30. The method of claim 1, wherein advancing the fixed diameter cone expander through the tubing occurs without expanding the tubing with the expansion tool.

* * * * *